United States Patent [19]

Sands

[11] 4,446,511

[45] May 1, 1984

[54] AUTOMOTIVE LAMP UNIT

[75] Inventor: Robert W. Sands, Hudson, Ohio

[73] Assignee: General Electric Company, Schenectady, N.Y.

[21] Appl. No.: 386,843

[22] Filed: Jun. 9, 1982

Related U.S. Application Data

[63] Continuation-in-part of Ser. No. 130,254, Mar. 14, 1980, abandoned.

[51] Int. Cl.[3] ..... F21V 29/00

[52] U.S. Cl. ..... 362/267; 362/61; 362/80; 362/307; 362/308; 362/309; 362/310; 362/339; 362/83; 362/375; 313/113

[58] Field of Search ..... 362/61, 80, 83, 375, 362/267, 307, 308, 309, 310, 339; 313/113

[56] References Cited

U.S. PATENT DOCUMENTS 4,249,232 2/1981 Dick ..... 362/267

*Primary Examiner*—Stephen J. Lechert, Jr.

*Attorney, Agent, or Firm*—John F. McDevitt; Philip L. Schlamp; Fred Jacob

[57] ABSTRACT

An improved automotive lamp unit is provided having a shape to reduce the air resistance when the automotive vehicle moves. Specifically, the lens member of said automotive lamp construction is aligned in a non-vertical direction when bonded directly to the reflector member so that the lamp unit slips through the air with less resistance than occurs with the conventionally designed unit. The preferred embodiments illustrate various shapes of the lens member to include both rectangular-shaped and circular-shaped lens members having various prism element constructions.

11 Claims, 3 Drawing Figures

AUTOMOTIVE LAMP UNIT

This application is a continuation-in-part of application Ser. No. 130,254, filed Mar. 14, 1980, now abandoned.

BACKGROUND OF THE INVENTION

The present invention relates generally to modification of the lens member component for an automotive lamp unit having an inner surface with prism elements to focus light transmitted therethrough and further being adapted for direct bonding at an outer rim section to a reflector member of the lamp unit to provide a leak-proof enclosure. Said automotive lamp unit construction has particular utility for automotive headlights. Circular shaped headlights having such lens member construction have been used in motor vehicles for some time and are generally constructed of glass members permitting hermetic sealing of the unit by a reliable fusion seal. Rectangular shaped headlight units have also been introduced along with lamp units using lens and reflector members made of light transparent thermoplastic polymer materials and wherein the lens and reflector members can be bonded directly together with adhesives to provide a leak-proof enclosure.

In most of the automotive lamp units of this type now being used, however, both lens and reflector members have a generally symmetrical contour for ease of molding during manufacture as well as for ease of subsequent assembly together. Automotive lamp units of said conventional design are thereby assembled by bonding together at the rim regions of both reflector and lens members to provide vertical alignment of the smooth exterior surface of the lens member with respect to the longitudinal major axis of the lamp unit. Understandably, such conventional lamp unit construction produces maximum wind resistance when these lamp units are mounted at the front end of the automotive vehicle, such as headlights, fog lights, and the like.

It should further be appreciated that the light beam patterns for vehicle headlamps and vehicle foglights are substantially dissimilar. The light beam from a foglight is projected downwardly to reach the ground a short distance ahead of the vehicle. Any longer projection of this light beam is deemed objectionable since reflection by the fog droplets can produce considerable glare to the vehicle occupants. Accordingly, the prism elements for the foglight lens are specifically constructed to prevent light projection above a horizontal plane as evident in French patent No. 1,401,848, British patent No. 408,113, and Italian patent No. 573,924. Vehicle headlamps are required to project a light beam for a considerable distance from the vehicle, hence the prism elements of a lens member must direct the light forwardly rather than in a downward direction. For the most part, this is accomplished with the lens member aligned in a vertical direction and which can still produce some glare to the occupants of oncoming vehicles. Although tilted mounting of vehicle headlamps is known to provide aerodynamic streamlining, the accepted practice still maintains the lens member of the headlamp itself in a vertically aligned direction as evident in British patent No. 511,687 and recently issued U.S. Pat. No. 4,249,232. In the one known vehicle headlamp having a tilted lens member for aerodynamic streamlining (British patent No. 1,158,069), there is said to be no modification of the prism elements in order to reduce the glare problems thereby created. The known vehicle headlamp and foglight devices are also not of an all glass seal beam type construction but rather employ additional structural components not providing a hermetically sealed lamp enclosure for durability and long life.

SUMMARY OF THE INVENTION

It has now been discovered, surprisingly, that a significant reduction in the wind resistance being experienced by an automotive vehicle when moving can be provided through modification of the automotive headlamp unit alone and in a manner not requiring undue modification in the manufacture of the lamp components or assembly of these components together. Specifically, such reduction in aerodynamic drag resistance can be afforded by modification of the lens member for said automotive unit wherein the lens member for said automotive unit is shaped to lie in a non-vertical direction when bonded directly to the reflector member while extending the length of the prism elements in the lens member by a distance related to the angle of inclination for said lens member from the vertical direction. When said improved lamp unit is mounted in the automotive vehicle, the reduction in aerodynamic drag resistance for the lamp area amounts to five percent or greater depending upon the number and type of improved lamp units which are mounted on the front end of the vehicle. A specific lamp unit construction according to the present invention thereby includes a lens member made of a light transparent thermoplastic material adapted to be bonded directly at the outer rim region to a reflector member and having a smooth exterior surface with an inner surface including rows of longitudinally extending prism elements to focus the light being transmitted therethrough where the improvement comprises shaping the lens member to lie in a non-vertical direction when bonded to the reflector member while extending the length of the prism elements by a distance related to the angle of inclination for said lens member from the vertical direction. By simply extending the prism elements in the present lens member, it becomes unnecessary to modify the optical lens prescription in order to provide the same light pattern as obtained with a comparable lens member aligned in the customary vertical direction. As will be described in connection with the preferred embodiments, various shapes of the lens member provide the desired improvement including both circular-shaped and rectangular-shaped lens configurations.

In one preferred sealed beam headlamp embodiment, a vertical cross section of the modified lens member provides a triangular shape with the angle of inclination being defined by intersection between another vertical plane in the sealing surface of said lens member and a non-vertical plane through the prism elements of said lens member. Accordingly, said modified lens member can have a rectangular shape as defined by pairs of unequal length sides and wherein the longitudinally extending prism elements are aligned parallel with the shorter sides of the lens member. Said preferred lens member can further include a center section of prism elements to spread the light beam in a horizontal direction which cooperate with prism elements adjacent both sides of said lens member to retain any further spreading of the light beam in said horizontal direction.

In a different preferred sealed beam headlamp embodiment, a circular shaped lens member is provided according to the present invention wherein the longitudinally extending prism elements are aligned generally parallel with the angle of inclination. Said lens member embodiment can further have a generally convex shape wherein all prism elements have about the same length and shape.

DESCRIPTION OF THE PREFERRED EMBODIMENTS

Figure 1:
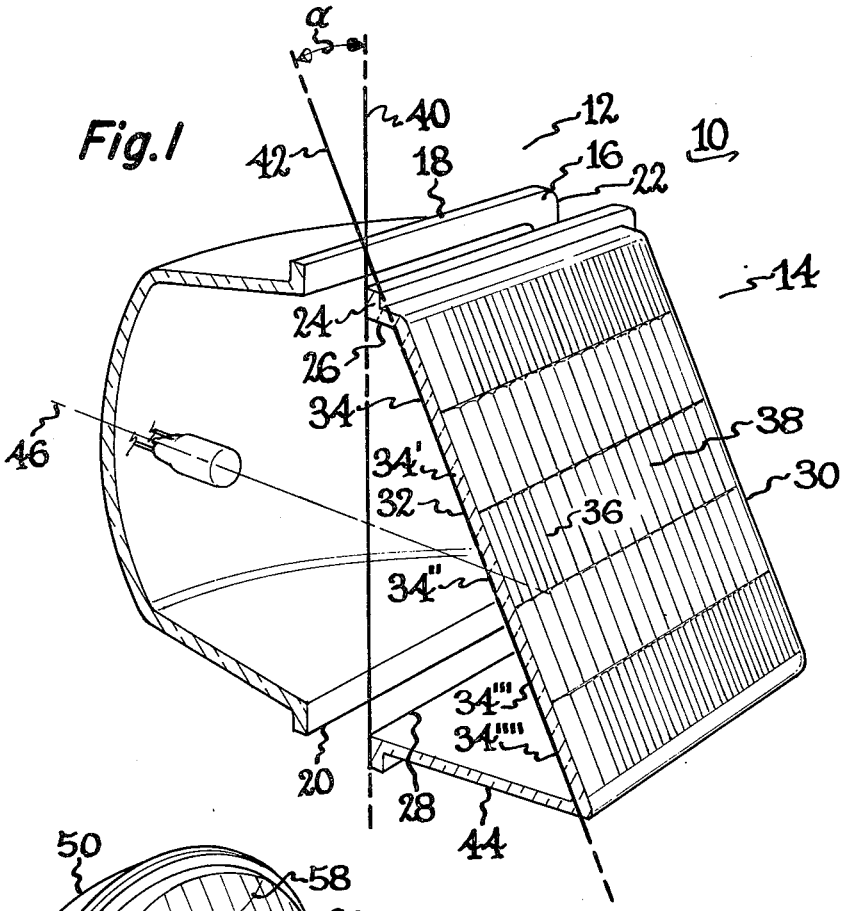
FIG. 1 is a perspective view partially in cross section of an improved rectangular shaped automotive lamp unit of the present invention prior to direct bonding of the reflector and lens members together and which illustrates the angular deflection of the lens member from the vertical direction.

Referring to the drawings, in FIG. 1 there is shown a preferred embodiment for a rectangular shape automotive sealed beam headlamp unit 10 which includes a rectangular-shaped reflector member 12 and a rectangular-shaped lens member 14 of light transparent thermoplastic material such as glass or synthetic organic polymer prior to being bonded directly together. Reflector member 12 includes a sealing rim section 16 having a rectangular shape defined by longer opposing sides 18 and 20 which are joined by shorter opposing sides 22 (of which only one shorter side has been shown). Correspondingly, the rectangular shaped lens member 14 includes a sealing rim region 24 as well as a generally parallel relationship between the opposing major sides of said member. Said parallel relationship exists between longer sides 26 and 28 which are intersected by opposing shorter sides not specifically shown in the drawing. Said lens member 14 has a further planar contour defined by a smooth exterior surface 30 with an inner surface 32 including rows of longitudinally extending prism elements 34, 34', 34'', 34''', and 34''''. As can be further noted, said prism element construction includes a center section of prism elements 36 to spread the light beam in the horizontal direction in which cooperate with prism elements 38 adjacent each shorter side of said lens member to restrain any further spreading of the light beam in said horizontal direction.

As can also be noted from said drawing, the vertical cross section through said lens member provides a triangular shape defined by a vertical plane 40 taken through the sealing rim region of said lens member and which intersects with a non-vertical plane 42 taken through the prism elements of said lens member. The base 44 of said triangular shape is provided by a bottom portion of said lens member which extends forwardly along the longitudinal automotive vehicle axis when the lamp unit is mounted in said vehicle as a headlight and with said longitudinal vehicle axis being represented as center line 46 of the lamp unit. The angle of inclination $\alpha$ for said lens member is thereby defined by intersection between the planes 40 and 42 as representative of the amount of deflection of the prism elements from a vertical orientation. It is only necessary to lengthen the prism elements of said lens member construction by an amount directly proportioned to said angle of inclination in order to preserve the same light pattern that would be projected with the same lens prescription when oriented in a vertical direction.

Figure 2:
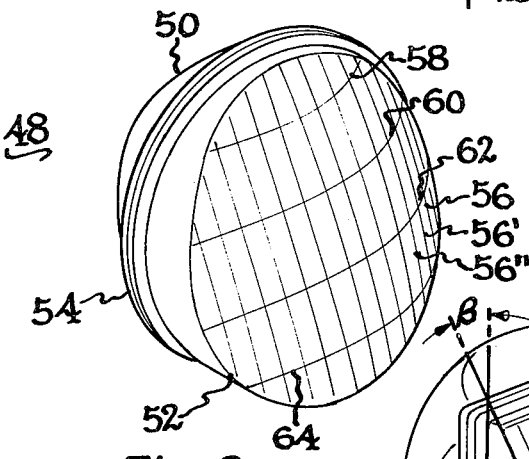
FIG. 2 is a perspective view of an improved circular shaped lamp unit according to the present invention after assembly.

In FIG. 2 there is shown a circular shaped automotive sealed beam headlamp unit 48 which includes reflector member 50 and lens member 52 after direct bonding together in a rim region 54. Said lens member 52 further includes representative longitudinally extending prism elements 56, 56', and 56'' which are all of approximately the same length and shape and located on the inner surface of said lens member in rows 58–64. As can be further noted from the drawing, said lens member has a generally convex shape which is aligned in a non-vertical direction when sealed to the reflector member 50 so that the prism elements are aligned generally parallel with the angle of inclination from said vertical direction. Accordingly the length of said prism elements is extended by a distance related to said angle of inclination for said lens member from the vertical direction in the same manner previously above described. Various similar constructions of the circular shaped lens member can exhibit the same improvement to include having a smooth exterior surface which is planar as well as having prism elements of different size and shape which cooperate in projecting a light beam in the desired direction.

Figure 3:
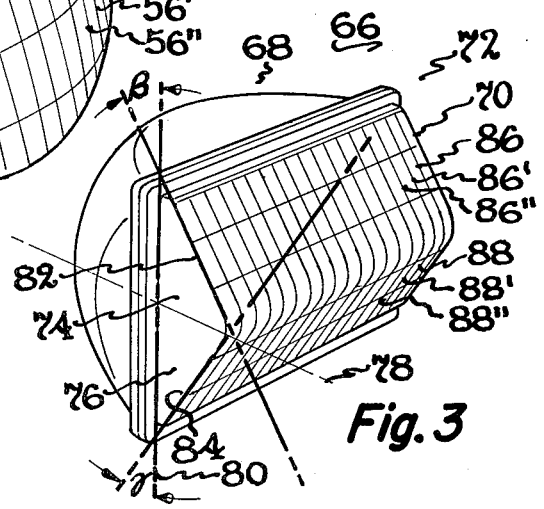
FIG. 3 is a perspective view of a still different modified rectangular shaped lens member constructed according to the present invention.

A modification 66 of the rectangular-shaped sealed beam headlamp construction described in FIG. 1 is depicted in FIG. 3. Accordingly, a rectangular shape reflector member 68 is shown bonded directly to a lens member 70 in the rim region 72 with a vertical cross section of said lens member providing a pair of right triangles 74 and 76 joined in abutting relationship as shown by a horizontal plane 78 disposed at the triangle bases. Vertical plane 80 extending through the sealing rim surface of said lens member defines angles of inclination $\beta$ and $\gamma$ by intersection with non-vertical planes 82 and 84 which extend through the prism elements of said lens member. Representative prism elements 86, 86' and 86'' are thereby extended longitudinally by a distance related to the angle of inclination $\beta$ for said lens member whereas representative prism elements 88, 88' and 88'' are also extended longitudinally by a distance related to the angle of inclination $\gamma$ for said lens member.

It will be apparent from the foregoing description that a generally improved lens member construction has been provided for an automotive sealed beam headlamp unit. It will be apparent that modifications can be made in the specific shape of the improved lens member other than above specifically described, however, without departing from the true spirit and scope of this invention. As has been above indicated for illustration, it is within the present contemplation to provide a circular-shaped lens member having an exterior planar surface and provided with prism elements on the inner surface which include a center section of prism elements to spread the light beam in a horizontal direction and which cooperate with prism elements adjacent to both sides of said lens member to retain any further spreading of the light beam in said horizontal direction. Consequently, it is intended to limit the present invention only by the scope of the appended claims.

What I claim as new and desire to secure by United States Letters Patent is:

1. An improved all glass sealed beam vehicle headlamp having a glass reflector directly fusion sealed at an outer sealing rim to a corresponding sealing rim of a single glass lens member to produce a hermetically sealed enclosure, said single lens member having a smoother exterior surface with an inner surface utilizing a single prism element construction with rows of longitudinally extending prism elements to project light being transmitted directly from said reflector therethrough for a substantial distance from the vehicle, wherein the improvement comprises shaping the single lens member to lie in a non-vertical direction when sealed to said reflector member while extending the length of the prism elements by a distance related to the angle of inclination for said single lens member from the vertical direction in order to project approximately the same light beam pattern as obtained with a lens member aligned in the customary vertical direction.

2. A vehicle headlamp as in claim 1 wherein a vertical cross section of said lens member provides a triangular shape with the angle of inclination being defined by intersection between another vertical plane through the sealing surface of said lens member and a non-vertical plane through the prism elements of said lens member.

3. A vehicle headlamp as in claim 1 wherein a vertical cross section of said lens member provides a pair of right triangles in abutting relationship at the triangle bases and with the angle of inclination being defined by intersection between another vertical plane through the sealing surface of said lens member non-vertical planes through the prism elements of said lens member.

4. A rectangular shaped vehicle headlamp as in claim 1 defined by pairs of unequal length sides and wherein the longitudinally extending prism elements of said lens member are aligned parallel with the shorter sides of said lens member.

5. A circular shaped vehicle headlamp as in claim 1 wherein the longitudinally extending prism elements of said lens member are aligned parallel with the angle of inclination.

6. A vehicle headlamp as in claim 2 wherein the bottom portion of said lens member extends further forward along the longitudinal vehicle axis.

7. A vehicle headlamp as in claim 2 wherein the top portion of said lens member extends further forward along the longitudinal vehicle axis.

8. A vehicle headlamp as in claim 4 wherein said lens member further includes a center section of prism elements to spread the light beam in a horizontal direction and which cooperate with prism elements adjacent each shorter side of said lens member to restrain any further spreading of the light beam in said horizontal direction.

9. A vehicle headlamp as in claim 5 wherein said lens member has a generally convex shape which further includes a center section of prism elements to spread the light beam in a horizontal direction and which cooperate with prism elements adjacent both sides of said lens member to restrain any further spreading of the light beam in said horizontal direction.

10. A vehicle headlamp as in claim 5 wherein the smooth exterior surface of said lens member is planar.

11. A vehicle headlamp as in claim 5 wherein said lens member has a generally convex shape and all prism elements have about the same length and shape.

* * * * *